US006476328B2

(12) United States Patent
Agostinelli

(10) Patent No.: US 6,476,328 B2
(45) Date of Patent: Nov. 5, 2002

(54) AUDIO SIGNAL CONNECTION CABLE FOR RECORDING AND REPRODUCTION DEVICES

(76) Inventor: Paolo Agostinelli, Santa Croce 2257A, 30135 Venice (IT)

( * ) Notice: Subject to any disclaimer, the term of this patent is extended or adjusted under 35 U.S.C. 154(b) by 0 days.

(21) Appl. No.: 09/965,860

(22) Filed: Oct. 1, 2001

(65) Prior Publication Data

US 2002/0053459 A1 May 9, 2002

Related U.S. Application Data

(62) Division of application No. 09/509,025, filed as application No. PCT/IT98/00204 on Jul. 21, 1998, now Pat. No. 6,399,885.

(51) Int. Cl.[7] ..... H01B 11/06
(52) U.S. Cl. ..... 174/113 R; 174/36
(58) Field of Search ..... 174/113 R, 36, 174/115, 116; 333/1, 243

(56) References Cited

U.S. PATENT DOCUMENTS

| | | | | |
|---|---|---|---|---|
| 4,599,483 A | | 7/1986 | Kuhn et al. | |
| 4,777,324 A | | 10/1988 | Lee | |
| 4,997,992 A | | 3/1991 | Low | |
| 5,110,999 A | | 5/1992 | Barbera | |
| 5,220,130 A | | 6/1993 | Walters | |
| 5,666,452 A | * | 9/1997 | Deitz et al. | 174/24 |
| 5,929,374 A | | 7/1999 | Garland | |

* cited by examiner

*Primary Examiner*—Chau N. Nguyen
(74) *Attorney, Agent, or Firm*—Young & Thompson

(57) ABSTRACT

A connection cable for an audio signal in recording or reproduction devices. The cable may be calibrated and includes a plurality of gold, copper, and silver conductor wires. The wires are connected in parallel with the going different from the return. A silk or cotton dielectric is used to insulated the wires and to insulate braidings surrounding the wires. Pure copper connectors are connected to the wires.

5 Claims, 2 Drawing Sheets

FIG.4
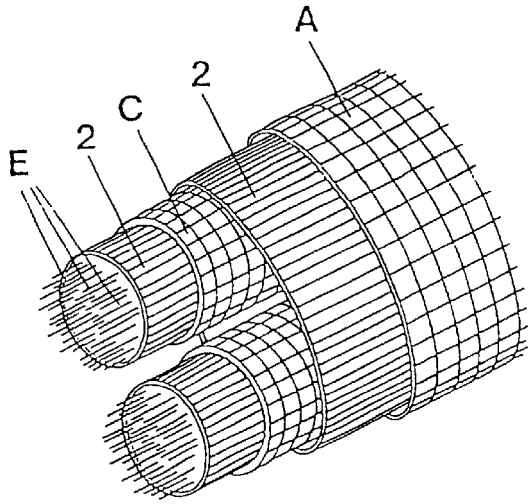
FIG.5
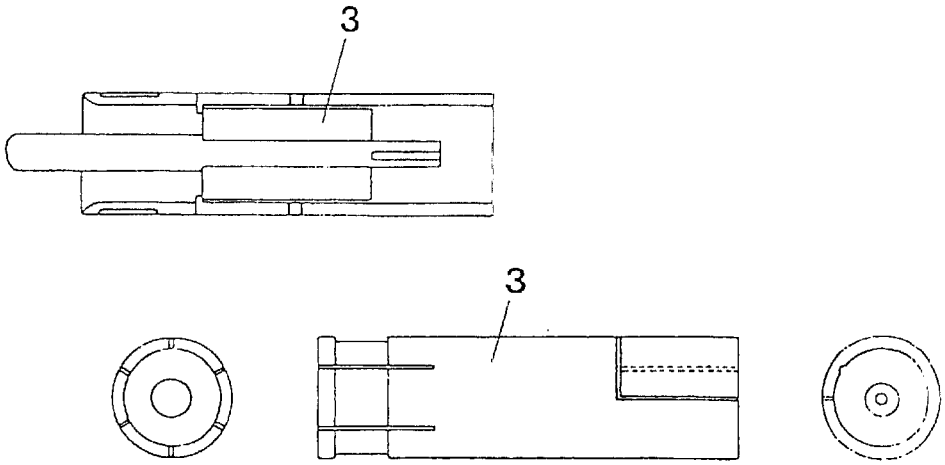
FIG.6
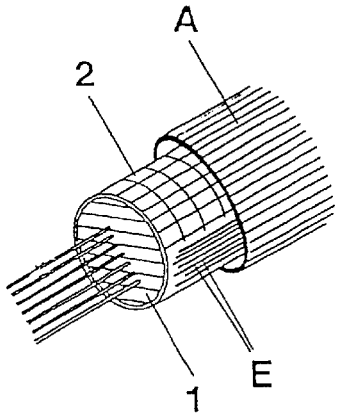
FIG.7

AUDIO SIGNAL CONNECTION CABLE FOR RECORDING AND REPRODUCTION DEVICES

This application is a division of application Ser. No. 09/509,025, filed on Mar. 21, 2000. now U.S. Pat. No. 6,399,885 application Ser. No. 09/509,025, is the national phase of PCT International application No. PCT/IT98/00204 filed on Jul. 21, 1998 under 35 U.S.C. §371. The entire contents of each of the above-identified applications are hereby incorporated by reference.

BACKGROUND OF THE INVENTION

The present invention concerns a connection cable between a plurality of devices, an audio recording or reproduction system, realized with copper, silver, gold and silk or cotton dielectric wires, with the possibility of calibrating said cable, and with contact devices or connectors.

It is well known that an audio amplification system consists—in a scheme—of a signal source, of one or more amplification phases and of electroacoustic transducers. The many devices may all be contained in one single unit, called integrated system, or also in different containers connected with each other by suitable cables.

Generally, an audio system may consist of:

an audio source;

a converter for transforming the digital signal into an analogic one;

a pre-amplifier;

a power amplifier and a loudspeaker system.

All these devices are connected between each other by suitable electric cables, usually different, because the kind of electric signal is different in amplitude and electric power according to the connection.

Even if said connection is very simple, experience shows that the influence of the cables onto the quality of the. reproduced signal is determining, and that the connection contact between the devices, realized with a connector generally of the RCA-type, is very important.

Said contact is influenced in a determining manner by the employed material, which produces not only electric effects onto the reproduced signal, but influences the quality and the tone-colour of the reproduced sound.

In fact, the connection cable and the kind of contact influence:

the tone-colour of the signal;

the spatial reconstruction of the audio message;

the loss of informations;

the focusing of the sound sources;

the dynamic;

the audibility of the sound event;

the naturalness of the reproduced sound.

The variation determined in the signal by the cable, which from now on will be considered as comprising the contact connector, is such that it may be considered a decay of the reproduced signal with respect to the original event, or an altered signal due to the connection cables.

For the purpose of optimizing the cables and for reducing their influence on the signal to a minimum, specialized cables are known to the art, according to the kind of signal, which may be devided in:

digital cables, signal cables, speaker cables.

The realization techniques of the cables are different according to the kind of signal they will transmit.

Considering first the digital and signal cables, usually the best electric conductors are used, like silver, gold, copper and, for the dielectric ones, the most sophisticated materials, as the currents as well as the tensions used are very small and the lengths very short.

A particular study has always been made on the geometry of the conductors, with the aim of reducing the influences of the external electric fields and of the ones generated by the same signal currents.

In fact, experience teaches that changing the arrangement of the wires and the kind of screening, different acoustic results are obtained. In fact, the screening is very important; the conventional coaxial cable has proved not to be the best system for the transmission of the audio signal, even if it offers a perfect protection from external inconveniences.

The present invention came out from the experimental verification that a screening made on signal wires and another screening made on earth wires, return signal, determine a better reproduction of the sound; a further increase is obtained by further screening the two coaxial cables obtained by means of the connection of the external screen to earth.

As already mentioned, the material of the connector also influences the reproduced sound; the experiments performed in view of the present invention have shown that the pure copper connector supplies the best transmission of the audio signal in acoustic terms, as it has no particular colours.

The materials used up to now—usually brass or alloys containing also brass—considerably alter the reproduced sound. The realization of pure copper connectors is linked to problems, as said metal is not elastic and this feature makes a safe contact very difficult in time, because the material permanently loses its shape.

SUMMARY OF THE INVENTION

According to the present invention, the problem has been solved exploiting the elasticity of a spring or of an elastic support like a small rubber pipe, wrapped around the connector's body, so as to form the elastic part of the same. Now the copper will be galvanized with successive layers of suitable metals for avoiding the oxidation of the surface layer. Of course, also other means may be applied for bringing elasticity.

Experiments with connectors out of alloy copper have brought lower results.

It is important to underline how the influences of the single components get added in the realization of the cable, having thus a considerable overall influence onto the reproduced audio signal. Therefore, the complexity of the system has allowed to realize rather different cables: in fact, the art shows cables with the most sophisticated geometries, with different conductor materials and with the most different dielectrics.

It is the aim of the present invention to realize connection cables so as to obtaine the best electroacoustic response, with a minimum of colour, agreeableness in listening without the artfulness of the sound typical of the cables realized with synthetic materials, and with the possibility of varying—according to the requests—the response to the signal of said cable.

The aim set forth is reached, according to the present invention, by means of a connection cable, that may be calibrated, for the audio signal in recording or reproducing devices, consisting of a plurality of conductors out of gold, copper and silver, connected in parallel, of equal or different sections, with a silk or cotton dielectric, for the insulation of the wires and of the braidings, preferably black, and with connectors out of pure copper.

The advantages of the cables according to the present invention consist in that said black silk or cotton dielectric has the feature of not colouring the sound, as well as the pure copper connector, thus realizing a reproduction with a particularly natural tone-colour, while the parallel connection of connectors of said different metals—following to the variation in the relationship between the metal quantities—allows to obtain a calibrating of the reproduced sound.

BRIEF DESCRIPTION OF THE DRAWINGS

The present invention will be described more in detail hereinbelow relating to the enclosed drawings in which some embodiments are shown.

FIGS. 3 and 4 show an axonmetric and section view of respectively a digital, a signal and a power cable.

FIGS. 5 and 6 show a longitudinal section of a connector according to the present invention.

FIG. 7 shows a variant of a cable with a non symmetric realization of the going and return wires of the electric signal.

DESCRIPTION OF THE PREFERRED EMBODIMENTS

Figure 1:
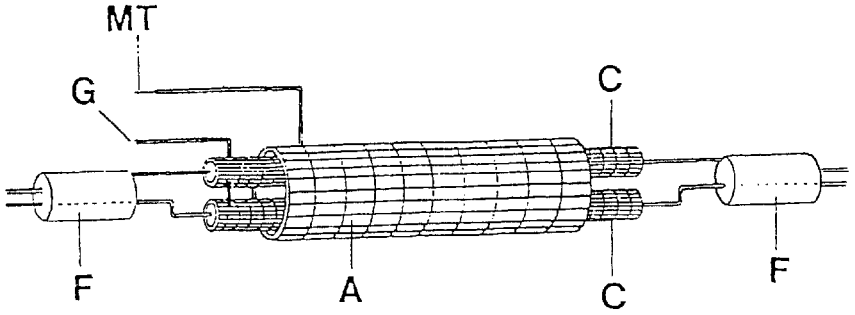
FIG. 1 shows an axonometric and transparency scheme of the cable-signal connection, according to the present invention.
Figure 2:
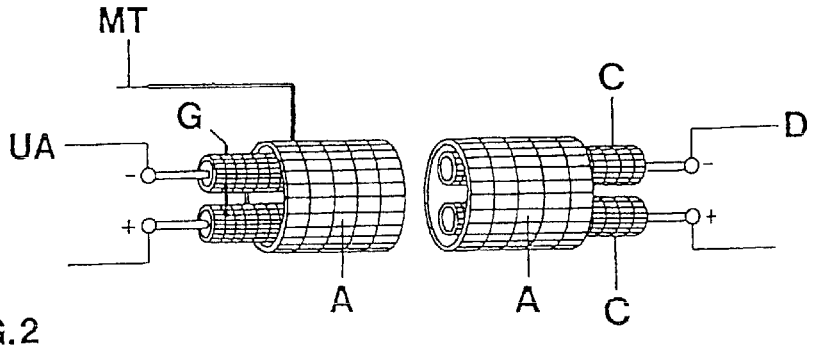
FIG. 2 shows the scheme of the connection system of power cables.
Figure 3:
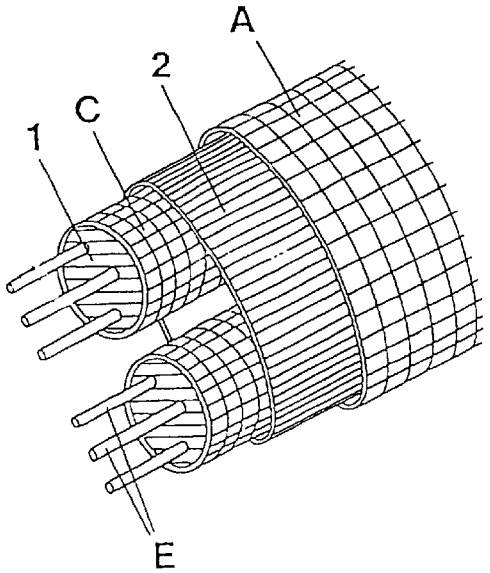

The enclosed figures show a connection cable, that may be calibrated, for the audio signal in recording or reproduction devices, wherein the connection between the cable-signal, the power cables between the outlet of the amplifier UA and the diffuser D comprise, besides the earth M, which in turn is provided with silk or cotton insulating layers:

an external braiding A, an internal braiding C, a plurality of conductors E, a connector F, an electric connection G.

For what concerns the structure of the digital and signal cables shown in FIG. 4, the present invention provides layers 1 of silk or cotton dielectric, preferably black, for insulating the wires F, and layers 2 for insulating braidings A and C from each another, with gold, silver and copper wires E and/or pewter or metal pewter gilt in the respective relationships of for example 1/3, 1/3, 1/3, for obtaining—by using more silver—sounds on high tones, or using more gold, sounds on low tones, or more copper for underlining the central sounds.

By operating onto the relationship between the metals, e.g. taking away the gold and making use of seven copper and two silver wires, a cable is obtained somewhat less complete, slightly "dry", but very balanced and natural.

The present invention also provides a non-symmetric realization of the going and return wires of the electric signal, according to which the going wires may be different in number, section and material from the return ones, and thus making the calibration of the wire, as already described, easier. In the example shown in FIG. 7, the going consists of seven copper and two silver wires, and the return of seven copper wires.

The sections of the wires are as important as the metals used; in fact, by varying the sections, controllable and repeatable sound variations may be obtained.

In general, if a plurality of wires is used with different sections for the same metal, a more accurate calibration of the kind of reproduced sound is obtained, considering the total tone the metal confers to the cable's sound.

In fact, in an exemplification of the cable according to the present invention, a more precise calibration may be obtained with three wires: a golden, a silver and a copper one, each one of the diameter of 0.40 mm, and three wires of 0.70 mm and three wires of 0.22 mm diameter, all insulated one from the other; this means that, e.g., by increasing the number of 0.70 mm wires, a predominance of low sounds is obtained, while increasing the 0.22 mm wires a predominance of high sounds is obtained.

Finally, the importance of the dielectric shall be underlined for what concerns the transmission of the signal, also in the use of connection connectors; instead of synthetic insulators, the present invention provides the use of wood for insulating the central contact of the connect or, with the experimental result of a more natural, less coloured reproduction, even with respect to the most advanced synthetic dielectrics.

It is evident that mentioned natural materials like wood and silk have proved to be functional also for the realization of signal cables.

Therefore, the connector realized according to the present invention consists of a female and of a male, with a pure copper body 3 and a wooden insulator.

The same above mentioned considerations may be applied to speaker cables, even if the use of copper wires with different sections has proved to be more practical.

In fact, the possibility of calibrating the cables making use of the relationship between the sections, has been used for the speaker cables because due to their lengths—even four/five meters—and the currents carried a peak of even 25A—it is not convenient to use precious metals.

Furthermore, only insulated copper wires with different sections may be used with the technique of the cable with double screening and silk dielectric. In fact, according to the present invention it is possible to obtain the desired sound in the realization phase, or even in the installation phase, by simply varying the number of the connected wires and with a relationship between the different sections and the kind of sound that may be obtained. A kind of power cable may be realized, e.g., by making use of:

two 1.5 mm wires, four 0.9 mm wires, twenty 0.4 mm wires, one hundred and twenty 0.22 mm wires, five hundred 0.07 mm wires;

all wires used are insulated (enameled wires, usually employed for the realization of transformers), except the five hundred 0.07 mm wires, which are obtained making use of a cable with 0.07 mm, not insulated strands, with a total section of 1.5 mm.

In terms of acoustic and comparing the cables according to the present invention with other cables of the best existing realizations, they have enlarged the sound scene with an accentuated sharpness and separation between the instruments, a wider opening and an extension of the low scale and a reduction of the sound harshness.

By maintaining the relationship between the sections, the number of wires may be doubled obtaining another cable which even more stresses the quality of the first cable.

In a further variant of the cable according to the present invention, a cable may be obtained multiplying by four above mentioned wires, with results of absolute excellence.

For obtaining the best result, a double screening with silk dielectric must be used. The power cables may be realized also without screening, or with one screening or with a higher number of screenings. The screens supply a greater clearness to the reproduced sound.

The possibility of varying the number of the screenings may be applied also to the signal and digital cables.

The advantages of the present invention are many and important: the digital or signal cable has a minimum tone-colour and loss of informations, with an absolutely natural tone and a capacity of reproducing the sound message of absolute importance.

The realization may be with a single, double, triple screening; according to the present invention, the main feature consists in that the dielectric is out of natural silk or cotton, possibly black. In fact, it has proved that black silk gives a better sound than other colours, even if also the use of a natural silk or cotton of other colours is effective.

Even if the connector is part of the present invention, it may be not out of pure copper, but a conventional connector.

The speaker cable may be also realized making use of wires of different precious metals, even if it has proved to be more practical and less expensive if it is realized in enameled copper with different sections, with the possibility of obtaining the desired acoustic reproduction.

What is claimed is:

1. A calibratable connection cable for an audio signal in recording or reproduction devices, comprising:

a plurality of wires being arranged in parallel positions and grouped into going wires and return wires, said going wires having different or equal cross-sections from said return wires;

a plurality of dielectric first layers for insulating said plurality of wires;

a plurality of first braidings encasing said plurality of wires;

a plurality of dielectric second layers for insulating said first braidings from a second braiding;

an earth insulated with silk or cotton; and a female and a male connector, said connectors being connected to said plurality of wires and each having a pure copper body and a wooden insulator.

2. The connection cable according to claim 1, wherein said plurality of dielectric first and second layers are a single, a double or a triple silk or cotton dielectric screening.

3. The connection cable according to claim 1, further comprising an elastic support wrapped around each of said connectors to form an elastic part of said connectors.

4. The connection cable according to claim 1, wherein the first and second dielectric layers are silk or cotton.

5. The connection cable according to claim 4, wherein the silk or cotton is black.

* * * * *